US007931416B2

(12) United States Patent
Yoon

(10) Patent No.: US 7,931,416 B2
(45) Date of Patent: Apr. 26, 2011

(54) SLIDE TYPE WRITING TOOL HAVING DEVICE FOR PREVENTING DRYNESS

(75) Inventor: Hyun-son Yoon, Seoul (KR)

(73) Assignee: Morris Corporation, Inchon-shi (KR)

( * ) Notice: Subject to any disclaimer, the term of this patent is extended or adjusted under 35 U.S.C. 154(b) by 660 days.

(21) Appl. No.: 11/837,395

(22) Filed: Aug. 10, 2007

(65) Prior Publication Data

US 2008/0193194 A1 Aug. 14, 2008

(30) Foreign Application Priority Data

Feb. 8, 2007 (KR) ..... 10-2007-0013052

(51) Int. Cl.
*B43K 5/16* (2006.01)
*B43K 7/12* (2006.01)
*B43K 24/02* (2006.01)

(52) U.S. Cl. ..... 401/108; 401/107; 401/99

(58) Field of Classification Search ..... 401/99, 401/115, 107–109
See application file for complete search history.

(56) References Cited

U.S. PATENT DOCUMENTS

| | | | | |
|---|---|---|---|---|
| 1,923,634 | A * | 8/1933 | Markstein | 401/108 |
| 2,362,948 | A * | 11/1944 | Teague et al. | 401/106 |
| 2,590,943 | A * | 4/1952 | Coskey et al. | 401/107 |
| 4,575,271 | A * | 3/1986 | Hashimoto et al. | 401/107 |
| 6,371,129 | B1 * | 4/2002 | Le Bras-Brown et al. | 401/108 |
| 7,220,073 | B2 * | 5/2007 | Yoon | 401/108 |

* cited by examiner

*Primary Examiner* — David J. Walczak
*Assistant Examiner* — Keegan Gumbs
(74) *Attorney, Agent, or Firm* — Intellectual Property Law Group LLP; Juneko Jackson; Otto O. Lee

(57) ABSTRACT

A slide type writing tool having a dryness prevention unit. The writing tool includes a hollow shaft having at a first end thereof a nib hole. A knock part is inserted into an insert hole formed in a second end of the shaft. A cartridge is inserted into the shaft and is integrated with the knock part. A control module is made of an elastic material, such as rubber, and includes an O-ring part coming into close contact with the nib hole, a spherical door having a spherical surface, a tubular holder secured to the cartridge, a first hinge coupling the O-ring part with the spherical door, and a second hinge integrally coupling the spherical door with the holder. First and second springs are provided in the shaft to act elastic restoring force between the control module and the cartridge.

5 Claims, 9 Drawing Sheets

SLIDE TYPE WRITING TOOL HAVING DEVICE FOR PREVENTING DRYNESS

CROSS-REFERENCE TO RELATED APPLICATIONS

This application claims priority to Korean Application No. 10-2007-0013052, filed Feb. 8, 2007, which is hereby incorporated by reference for all purposes.

BACKGROUND OF THE INVENTION

1. Technical Field

The present invention relates, in general, to writing tools and, more particularly, to a slide type writing tool having a dryness prevention unit, which is constructed so that a nib which dispenses ink supplied from a cartridge is projected out only when the writing tool is in use, and the nib is retracted into the writing tool to be sealed therein when the writing tool is not in use.

2. Background

Generally, writing tools are typically classified into fixed type writing tools, rotary type writing tools, knock type writing tools, and slide type writing tools. The fixed type writing tools are designed so that a cartridge is fixed and a cap is used to cover a nib. The rotary type writing tools are designed so that part of a cartridge moves along a spiral pipe to be projected out when part of a shaft is rotated. The knock type writing tools are designed so that a cartridge is projected out by a spring when part of a shaft is pressed. Further, the slide type writing tools are designed so that a cartridge slides to be retracted into and projected out of a shaft.

The slide type writing tools have an advantage in that it is unnecessary to open or close an additional cap. However, the slide type writing tools have a problem in that a nib hole is formed in an end of the writing tool, so that such a slide type structure may be limitedly applied only to non-volatile writing tools, such as oil-based ink, or to writing tools having low volatility.

Thus, writing tools having high volatility, for example, a marker pen, a correction pen, a roller ball pen, a highlighter, etc., must have caps, although it is inconvenient to open or close the caps. The reason why the writing tools having high volatility have the caps is that the ink of the nibs dries up when the nibs of the writing tools are exposed to the air, thus shortening the lifespans of the writing tools.

In order to solve the problems, efforts have been made to develop a writing tool that prevents the ink of the writing tool, which is a liquid or a semi-liquid ink, or a volatile or non-volatile ink, from drying up, while protecting a nib of the writing tool.

In order to prevent a nib from drying up and protect the nib, Korean U.M. Registration No. 172486, entitled 'slide type writing tool with a tip protective unit' was proposed, which was registered in 1999. According to the cited document, the writing tool is provided with the tip protective unit to prevent the nib thereof from drying up. In this case, the tip protective unit seals the tip of the nib while the products are transported and marketed, thus preventing ink from drying up.

However, the writing tool according to Korean U.M. Registration No. 172486 has a problem in that the tip protective unit must be discarded to use the writing tool, so that the writing tool then loses its dryness prevention function. Further, the writing tool is limited in application to ball-point pens.

Furthermore, from Korean U.M. Registration No. 174279, which was registered in 1999, there is known a nib dryness prevention unit. According to the cited document, when a push-button of a slide type writing tool is pressed, the nib passes through a cut slit of a rubber packing to be exposed to the atmosphere, so that a user can write with the writing tool. Then, when the push-button is released, or is pressed once more, the nib is returned to its original position, and the cut slit is closed by the elasticity of the rubber packing, thus preventing the ink from drying up.

However, the writing tool according to the cited document has a problem in that plastic deformation of the cut slit may occur due to frequent use of the writing tool. The writing tool has another problem in that it is difficult to seal the push-button that executes the sliding motion, so that sealing efficiency is low.

In Korean Patent Application No. 10-2000-65693 there was proposed a 'writing tool with inseparable elastic cap'. According to the cited document, the writing tool is provided with an elastic cap. The elastic cap has, at a predetermined position thereof, a cut slit through which a nib passes. Further, a predetermined portion of the elastic cap, which is opposite the cut slit, is in close contact with a guide groove of the writing tool. Thus, when the cap moves backward, the nib is exposed outside so that a user can write with the instrument. Conversely, when the cap moves forward, the cap prevents the ink from drying. The middle portion of the writing tool has the same shape as the body of a typical writing tool.

However, the writing tool according to Korean Patent Application No. 10-2000-65693 has a problem in that the portion around the cut slit may be stained with the ink of the nib, as the nib is exposed outside through the cut slit. Further, since the cut slit is closed by a subsidiary unit, such as a rubber ring, which is readily elastically deformed, the nib is in direct contact with the cut slit and is thereby broken or damaged, and the durability of the writing tool is relatively low. The writing tool is problematic in that the rubber ring is exposed outside the cut slit, so that the rubber ring may be damaged when the rubber ring comes into contact with an external object. Further, the cut slit may become deformed after frequent use of the writing tool, and thus the efficiency with which the nib is sealed may be deteriorated.

SUMMARY OF THE INVENTION

Technical Problem

Accordingly, the present invention has been made keeping in mind the above problems occurring in the prior art, and an object of the present invention is to provide a slide type writing tool having a dryness prevention unit which is rapidly opened or closed in a direct transmission manner and is convenient to use, thus allowing the end of a cartridge, that is, the nib, to be extended and exposed outside through a non-contact extension operation, while the area around the nib remains sealed. Further, the slide type writing tool having the dryness prevention unit prevents the ink of the nib from drying up without requiring the use of a cap, and safely protects the nib.

Another object of the present invention is to provide a slide type writing tool having a dryness prevention unit, in which a control means comprises an integrated control module, unlike a general control means having a link part, a spherical door part, a holder, and an O-ring which are separated from each other.

Technical Solution

In order to accomplish the objects, the present invention provides a slide type writing tool having a dryness prevention unit, including a hollow shaft having at a first end thereof a nib hole; a knock part inserted into an insert hole formed in a second end of the shaft; a cartridge inserted into the shaft to be concentric with the nib hole, and integrated with the knock part; a control module made of an elastic material, such as rubber, and including an O-ring part coming into close contact with the nib hole, a spherical door having a spherical surface to isolate the nib from an exterior, a tubular holder secured to the cartridge, a first hinge coupling the O-ring part with the spherical door, and a second hinge integrally coupling the spherical door with the holder; and a first spring and a second spring provided in the shaft and located between the control module and the cartridge to provide elastic restoring force, whereby, when the knock part is pressed, the spherical door, operated in conjunction with the knock part and the cartridge, is rotated at a rotating angle, thus opening the nib hole of the shaft, therefore causing the nib to be projected outside the nib hole through a passage of the spherical door.

Advantageous Effects

As described above, a slide type writing tool having a dryness prevention unit according to the present invention has advantages in that it can be used without opening or closing an additional cap, and a nib hole can be opened or closed by the extension or retraction of a nib, thus preventing ink from drying up.

Further, the slide type writing tool having the dryness prevention unit according to the present invention has an integrated control module, so that the assembly of the writing tool is simple, and the production cost of parts can be reduced, and thus the writing tool has high marketability, and appeals to consumers.

Furthermore, the slide type writing tool having the dryness prevention unit according to the present invention is advantageous in that the interior of a shaft that holds the nib is air-tightly sealed by a spherical door and a holder, thus increasing the lifespan of the ink, therefore maximizing the performance of the product.

Moreover, the slide type writing tool having the dryness prevention unit according to the present invention is advantageous in that a user holds the shaft corresponding to a body with one hand and manipulates a switch with his or her fingers to extend or retract the nib, therefore being very convenient to use.

Although a preferred embodiment of the present invention is disclosed herein for illustrative purposes, those skilled in the art will appreciate that various modifications, additions and substitutions are possible, without departing from the scope and spirit of the invention as disclosed in the accompanying claims.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only. Hereinafter, a slide type writing tool having a dryness prevention unit, according to the preferred embodiment of the present invention, will be described in detail with reference to FIGS. 1 to 16.

Figure 1:
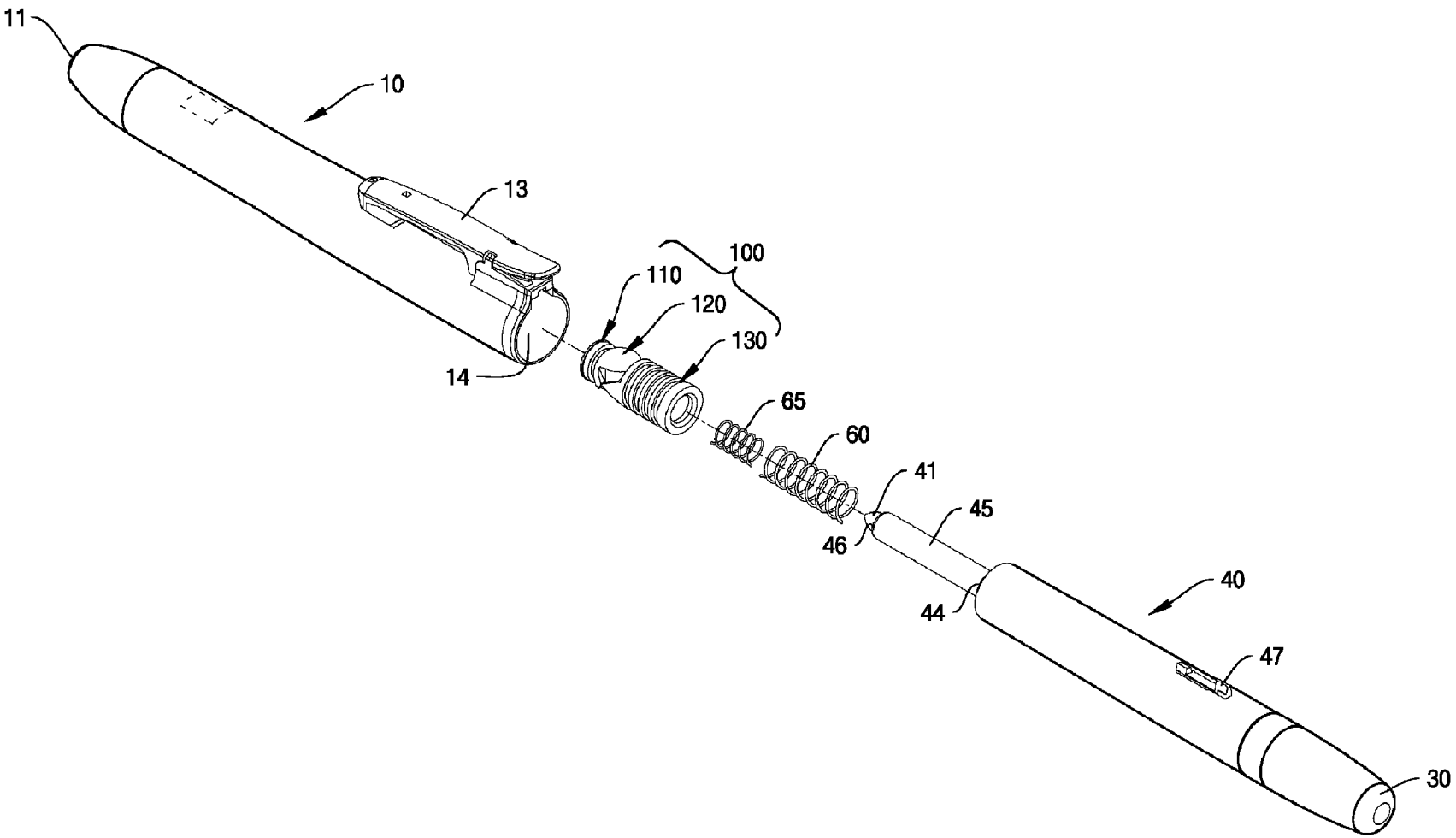
FIG. 1 is an exploded perspective view illustrating the external appearance of a slide type writing tool having a dryness prevention unit, according to an embodiment of the present invention.
Figure 2:
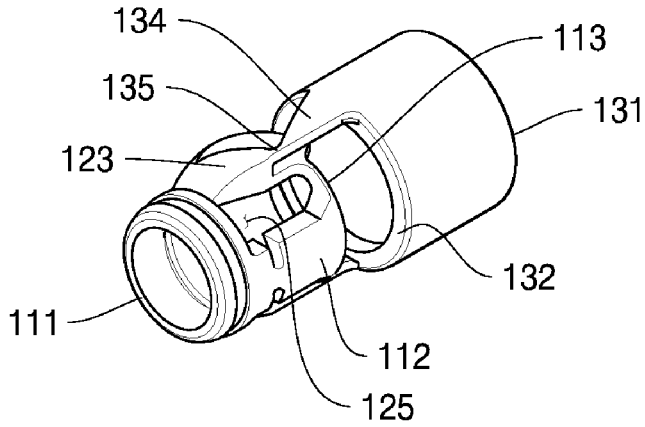
FIGS. 2 to 4 are front perspective views showing a control module of the slide type writing tool having the dryness prevention unit, according to the present invention.
Figure 3:
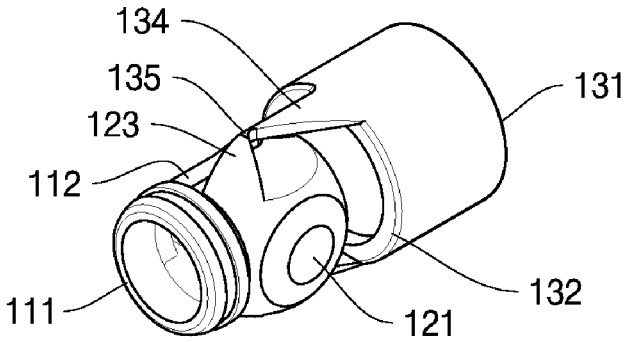
Figure 4:
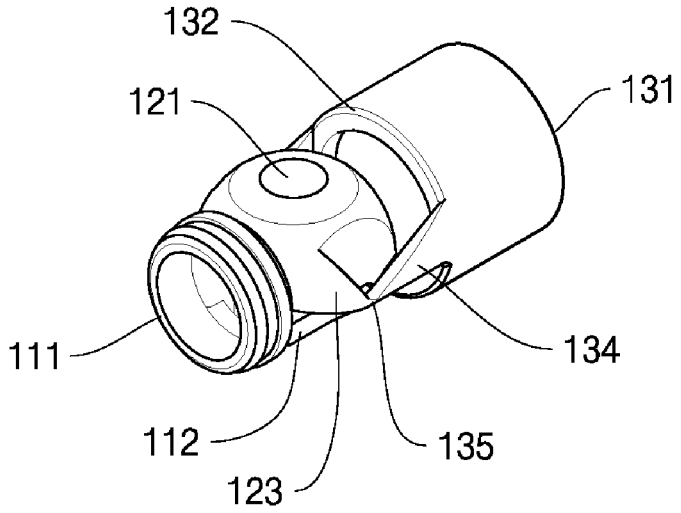

FIG. 1 is an exploded perspective view illustrating the external appearance of the slide type writing tool having the dryness prevention unit, according to an embodiment of the present invention, and FIGS. 2 to 4 are front perspective views showing a control module of the slide type writing tool having the dryness prevention unit, according to the present invention.

Figure 5:
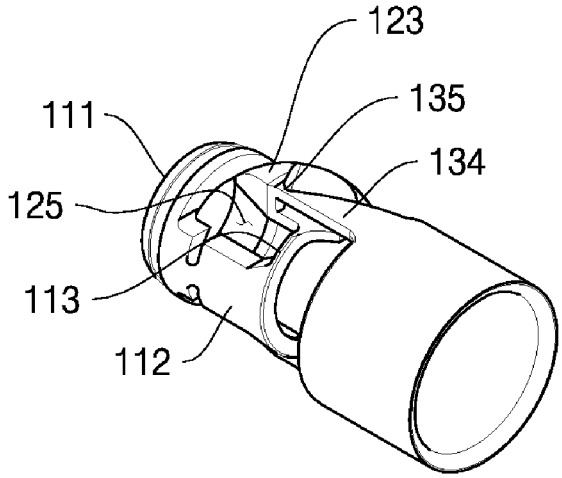
FIGS. 5 to 7 are rear perspective views showing the control module of the slide type writing tool having the dryness prevention unit, according to the present invention.
Figure 6:
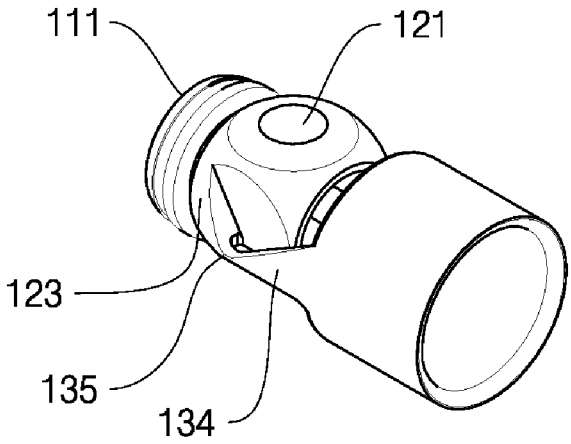
Figure 7:
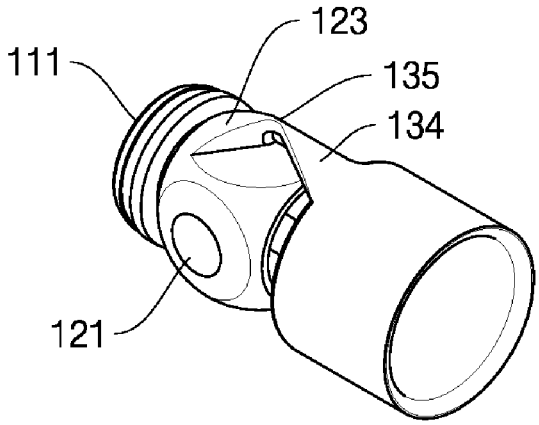
Figure 8:
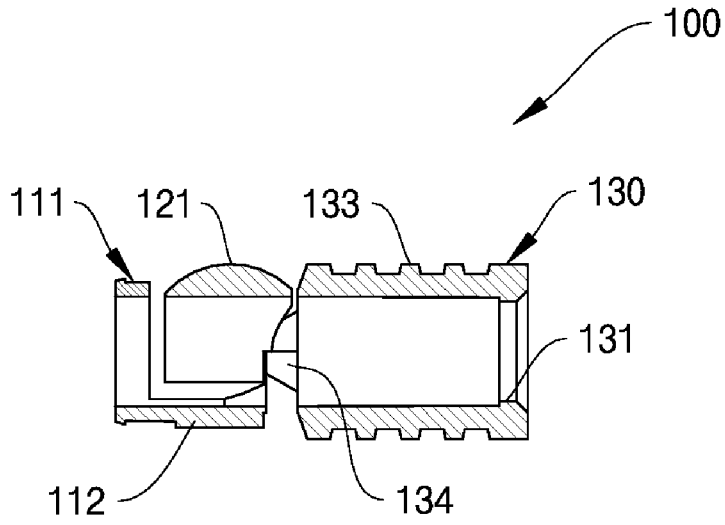
FIG. 8 is a sectional view of the control module.

FIGS. 5 to 7 are rear perspective views showing the control module of the slide type writing tool having the dryness prevention unit, according to the present invention, and FIG. 8 is a sectional view of the control module.

Figure 9:
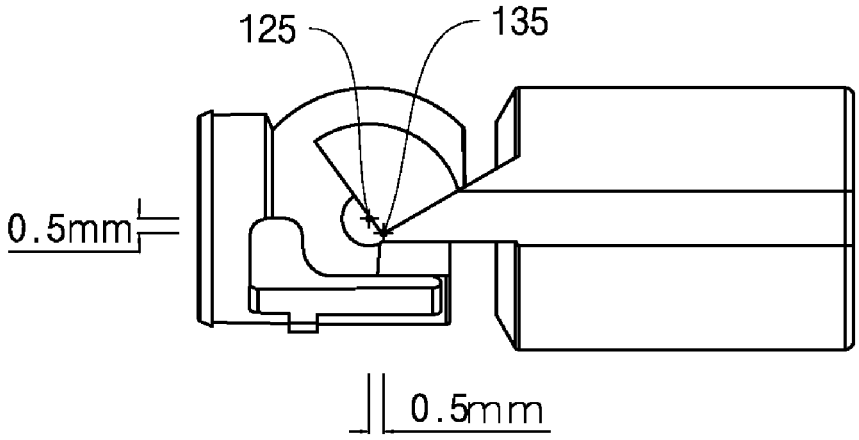
FIG. 9 is a sectional view showing the rotating central point of a spherical door of the control module.
Figure 10:
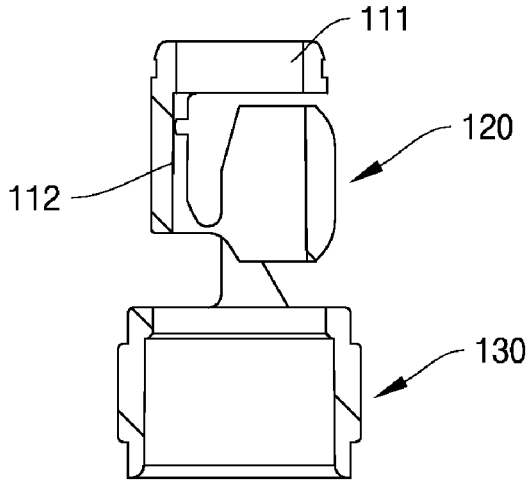
FIGS. 10 and 11 are sectional views showing the operation of the control module.
Figure 11:
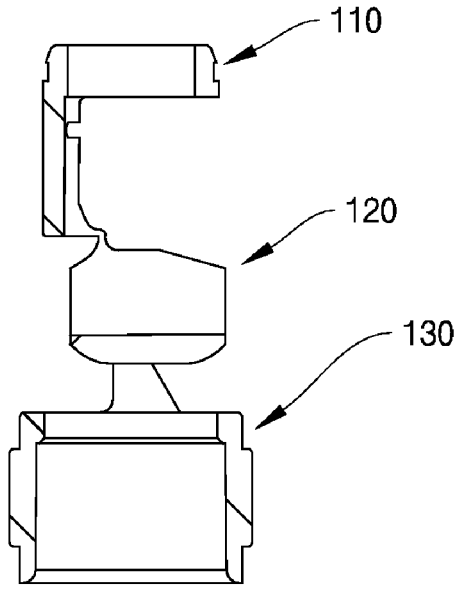

FIG. 9 is a sectional view showing the rotating central point of a spherical door of the control module, FIGS. 10 and 11 are sectional views showing the operation of the control module, and FIGS. 12 to 16 are schematic sectional views illustrating the operation of the control module when a nib is extended by pushing a knock part.

The writing tool of the present invention includes a shaft 10 which provides a single body or a body divided into two parts. A dryness prevention unit, which will be described below in detail and is rapidly opened or closed in a direct transmission manner, is installed in the shaft 10.

According to the present invention, the direct transmission manner means that a nib hole 11 of the shaft 10 is air-tightly sealed by a spherical door 120 of the dryness prevention unit, but, when a user pushes a knock part 30, the pushing force is directly transmitted to the spherical door, so that the spherical door 120 is operated.

The nib hole 11 is formed in one end of the shaft 10, which has a conical shape, while the knock part 30 is coupled to the other end of the shaft 10.

That is, the user holds the shaft 10 of the writing tool in one hand, and then presses the knock part 30 provided at the upper end of the writing tool, corresponding to a pressing part, with his or her thumb. At this time, the spherical door 120, which is operated in conjunction with a cartridge integrated with the knock part 30, rotates at a rotating angle of 90° in an opening direction, so that a passage 125 is axially aligned with the nib 41, and simultaneously, the nib hole 11 of the shaft 10 is opened.

Afterwards, the nib 41 projects out from the nib hole 11 through the passage 125 of the spherical door 120, so that the user can write with the writing tool.

Conversely, when the user presses the knock part 30, the projected nib 41 is returned to its original position, that is, is retracted into the shaft 10 by first and second springs which are provided in the shaft. Subsequently, the spherical door 120 is rotated at a rotating angle of 90° in a closing direction by the first and second springs, so that the passage is perpendicular to the nib 41, and simultaneously, the nib hole 11 of the shaft 10 is closed.

Referring to FIG. 1, the slide type writing tool having the dryness prevention unit according to the present invention mainly includes five parts, that is, the shaft 10, the cartridge 40, the first spring 60, the second spring 65, and a control module 100. The writing tool of this invention requires a smaller number of parts than a conventional writing tool, which requires ten or more parts, and is thus easy to assemble.

In the present invention, the shaft 10 may be manufactured through an injection molding process or a molding process using one of rubber, silicone, and soft plastics, thus providing a single body or a body which is divided into two parts.

Further, the shaft 10 has the general characteristics of plastics, namely, elasticity and flexibility.

The nib hole 11 is formed in one end of the shaft 10 and has a size which is sufficient to accommodate the nib 41 of the cartridge 40, while an insert hole 14 is formed in the other end of the shaft 10 and has a size which is sufficient to accommodate the body of the cartridge 40.

Further, an extension control part 13, which is designed to have various forms, is integrated with or is mechanically coupled to the outer circumference of the other end of the shaft 10. Preferably, the extension control part 13 is coupled to a locking part 47 so that the nib 41 maintains an extended or retracted state.

In a detailed description, when the knock part 30 is continuously pushed so that the nib 41 of the cartridge passes through the nib hole 11 and is extended out of the nib hole, and then the knock part 30 is released, the locking part 47 engages with the extension control part 13, thus preventing the cartridge having the nib from being moved backward by the restoring force of the first spring, which is interposed between the cartridge and the shaft. Meanwhile, when the knock part 30 is pushed again in the state where the nib is extended out, the extension control part is disengaged from the locking part. Thereby, as soon as the knock part 30 is released, the cartridge is moved backwards by the restoring force of the first spring, so that the nib is retracted into the shaft.

Further, the nib hole 11 is formed in one end of the shaft 10, which has a conical shape, while the insert hole 14 is formed in the other end of the shaft 10 and has an inner diameter sufficient to accommodate parts that will be described below, including the knock part 30. When showing the external appearance of the writing tool, the knock part 30 is integrally inserted into the insert hole 14.

Referring to FIG. 1, the knock part 30 serves to transmit a user's pushing force to the cartridge 40. Such a knock part 30 has the shape of a tube which has a smaller circumferential part and a larger circumferential part. One end of the knock part, corresponding to the smaller circumferential part, is open, while the other end of the knock part, corresponding to the larger circumferential part, is closed.

Further, according to the present invention, the cartridge 40 has a large-capacity tank which is capable of continuously and evenly discharging ink through the nib 41 for a predetermined period of time depending on the capacity of the ink tank.

Here, the nib 41 is provided on one end of the cartridge 40. Such a nib 41 is secured to a hole which is formed in one end of a nib extension shaft 45, so that ink is supplied to the nib.

The nib extension shaft 45 has the shape of a hollow circular tube to supply ink to the nib, and has a smaller diameter than the tank.

Further, the nib 41 is secured to an end of the nib extension part 45, and the contents stored in the tank, that is, ink, are fed from the tank to the nib 41 through a conventional ink feeding method adopted according to the kind of writing tool, for example, a feeding method using a capillary action, a feeding method using a pressure difference, a feeding method using suction, etc.

For the nib 41, a tip for oil- or water-based ink, a correction fluid discharge tip, a tip for highlighters, a tip for marker pens, or another kind of tip is used according to the kind of writing tool. It is possible to use a suitable ink feeding method according to the kind of tip.

The cartridge 40 is operated in conjunction with the extension control part 13. A general extension mechanism, used in a conventional writing tool having a cartridge, may be provided on the locking part 47.

Further, the cartridge 40 is operated in conjunction with the extension control part 13. An extension mechanism which is similar or equal to a safe knock type mechanism, disclosed in Korean Patent Application Nos. 10-2003-55414 and 10-2003-56940, which relate to a safe knock-type writing tool having a low noise cartridge extension mechanism and were filed with the KIPO by the applicant of this invention, may be provided on the locking part 47.

When the cartridge 40 is inserted into the cartridge insert hole 14 of the shaft 10, and then a user manipulates the extension control part 13, the nib 41 can reciprocate within a predetermined stroke range such that the nib 41 is extended out from or retracted into the nib hole 11 of the shaft 10 by the above extension mechanism, and can temporarily stop at both ends of the stroke.

The springs inserted into the shaft comprise the first spring 60 and the second spring 65.

one end of the first spring 60 contacts the lower end of a step 44 of the cartridge 40.

Subsequently, the first spring 60 is operated to axially bias either the shaft 10 or the cartridge 40 within the stroke distance of the cartridge 40.

For example, when the cartridge 40 and the knock part 30 move forwards by a predetermined stroke distance, the first spring 60 is compressed. Thereby, the first spring 60 generates elastic restoring force such that the compressed state is restored to an extended state.

According to the present invention, the stroke distance of the cartridge 40 is equal to the stroke distance of the knock part 30.

Further, the second spring 65 is fitted over the nib extension shaft 45 of the cartridge 40. An end of the second spring 65 contacts the upper end of the step 44. That is, the inserted second spring 65 is supported by the step 44 and the nib extension shaft 45.

Afterwards, the second spring 65 is operated to axially bias either the control module 100 or the cartridge 40.

For example, when the cartridge 40 and the knock part 30 move forwards, the second spring 65 is compressed to press the control module 100 for a short period of time, thus allowing the spherical door 120, which is rotatably provided on the control module 100, to be smoothly and rapidly opened or closed.

FIGS. 2 to 7 are perspective views showing the control module 100 in detail.

The control module 100 is manufactured through an injection molding process using an elastic material such as rubber. Thus, even though the control module 100 is repeatedly bent, the control module is resistant to fatigue, so that the durability of the control module is good. Further, the spherical door can be in closer surface contact with an inlet of a holder, which will be described below, thus very effectively preventing ink from drying up.

The control module 100 is constructed so that an O-ring part 110, the spherical door 120, and the holder 130 are integrated with each other into a single structure.

An O-ring 111 of the O-ring part 110 is ring type packing which is in surface contact with the nib hole 11 of the shaft 10, to thus be secured to the nib hole.

After the O-ring 111 is integrated with the spherical door 120, parts (the upper end of the spherical door and the lower end of the O-ring) which are to be separated to each other to open or close the spherical door are cut.

A vertical bar 112 of the O-ring part 110 is a support bar that extends vertically from the lower end of a predetermined position on the O-ring 111.

The spherical door 120 serves as a follower of the holder 130. As a result, the spherical door serves as a door for opening or closing the nib hole 11.

To this end, the spherical door 120 has a hemispherical surface 121.

Further, the open passage 125 is formed in a portion opposite the hemispherical surface 121 of the spherical door 120, and provides a path for the extension and retraction of the cartridge when the writing tool is operated.

The spherical door 120 has spire-shaped coupling parts 123 which extend from the hemispherical surface 121.

The holder 130 is assembled with the cartridge 40 and thus fastened to the cartridge.

That is, a step of a lower opening 131 of the holder 130 is locked to a step of a connection part 46, thus preventing the cartridge 40 from being removed from the holder 130.

Further, an upper opening 132 of the holder 130 has a diameter which is smaller than the diameter of the spherical door 120 but is larger than the diameter of the cartridge 40, so that the upper opening 132 of the holder 130 is in close contact with the hemispherical surface 121 of the spherical door 120.

Particularly, during the manufacture of the writing tool, the diameter of the core inserted into the upper opening 132 of the holder 130 is smaller than the diameter of the core inserted into the passage of the spherical door 120. No dividing line is formed on the end of the upper opening 132 which is formed in this way. Such a construction allows the upper opening 132 of the holder to be in firm close contact with the spherical door 120, thus more efficiently keeping the nib watertight.

Preferably, a rubber packing may be provided along the inner surface of the upper opening 132, thus allowing the upper opening to be in closer contact with the hemispherical surface 121.

As shown in FIG. 8, ribs 133 are preferably formed on the holder 130. The ribs 133 are a plurality of circular bands which are made of a rubber material so as to be easily bent or folded, and are formed on the holder 130 at regular intervals to reinforce the holder.

Further, spire-shaped coupling parts 134 extend from both sides of the upper end of the holder 130, and are coupled at ends thereof to ends of the corresponding coupling parts 123 of the spherical door 120.

A second hinge 135 is the point where each coupling part 134 meets the corresponding coupling part 123. The second hinge 135 allows each coupling part 123 to rotate about the coupling part 134.

That is, each coupling part 134 is a triangular surface, both sides of which extend from left and right sides of the upper opening 132 and converge at one point, thus providing the second hinge 134 coupled to the coupling part 123 of the spherical door 120.

Further, after the coupling parts 134 are integrated with the spherical door 120, the cutting operation is executed at portions other than the second hinges 135 so as to provide separated portions which are used to rotate the spherical door 120.

As shown in FIG. 9, the spatial position of the second hinge 135 is set to deviate slightly from the central point 125 of the hemispherical surface of the spherical door 120, so that the second hinge serves as the center of rotation. In the drawing, the vertical deviation distance is 0.5 mm.

This position of the second hinge eliminates friction between the spherical door and the upper opening 132 of the holder, which may occur during rotation when the hinge is located at the central point of the hemispherical surface.

Further, first hinges 113 are coupling members for coupling an end of the vertical bar 112 extending from an end of the O-ring 111 with both sides of the lower end of the spherical door 120, and make the spherical door 120 perform a hinge action relative to the O-ring part 110.

To this end, each first hinge 113 preferably has the shape of a circular band. The end of the vertical bar 112 and the lower end of the spherical door 120 are integrally provided on the circular band.

The entire coupling of the control module 100 will be summarized as follows. The O-ring 111 is coupled to the vertical bar 112, the vertical bar 112 is coupled to the spherical door 120 via the first hinges 113, the spherical door 120 is coupled to the coupling parts 134 via the second hinges 135, and the coupling parts 134 are coupled to the upper opening 132 of the holder 130. In this way, the integrated control module 100 is realized.

Further, the control module 100 is operated as follows. When the holder 130 is pulled as shown in FIG. 10, the spherical door 120 is rotated as shown in FIG. 11, so that the second and first hinges 135 and 113 are rotated.

FIGS. 12 to 16 show the process of operating the knock part so as to open the nib hole 11 using the spherical door 120, starting from a first stroke position. That is, the passage of the spherical door 120 is perpendicular to the axial direction of the cartridge 40.

Further, the terms "forward direction" and "backward direction," which will be used below, mean the direction facing the nib hole 11 and the direction facing the knock part 30, respectively.

Figure 12:
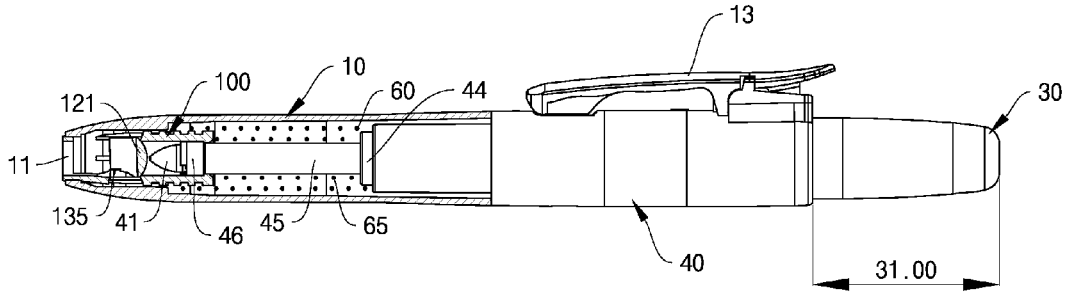
FIGS. 12 to 16 are schematic sectional views illustrating the operation of the control module when a nib is extended by pushing a knock part.

Particularly, the closed state of FIG. 12 is the state in which the assembly of the parts of FIG. 1 has been completed.

As shown in the drawings, the nib 41 is surrounded with the holder 130.

The step of the lower end of the connection part 46 of the cartridge 40 is locked to the lower opening 131 of the holder 130, so that the cartridge 40 does not move backwards from the holder 130.

Moreover, the step of the lower end of the connection part 46 is air-tightly locked to the lower opening 131, thus minimizing the evaporation of ink from the nib 41.

Since the O-ring 111 is in close surface contact with the nib hole 11, the undesirable removal of the O-ring is prevented.

The first spring 60 is interposed between the shaft 10 and the cartridge 40, thus biasing the shaft 10 and the cartridge 40.

Thus, the nib 41 of the cartridge 40 is moved backwards by the elastic force of the first spring 60. At this time, the lower opening 131 of the holder 130 locked to the connection part 46 also moves backwards.

However, since the O-ring 111 is positioned to be secured to the nib hole 11, the first and second hinges 113 and 135 are bent by the backward movement of the holder 130, and the spherical door 120 is rotated at 90° to close the upper opening 132 of the holder 130.

The second spring 65 is interposed between the holder 130 and the step 44 while there is no elastic stress.

Figure 13:
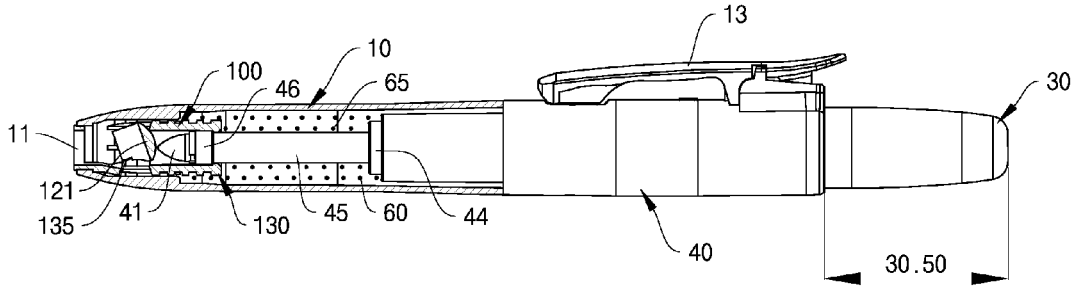

In such a state, when the knock part 30 moves forwards as shown in FIG. 13, the holder 130, the knock part 30, and the cartridge 40 are moved forwards a predetermined stroke distance (e.g.: 5 mm).

In this case, the first spring 60 maintains the above state, but applies elastic force, which is slightly increased according to the distance moved, to the cartridge 40. Simultaneously, the second spring 65 transmits force generated by the forward movement of the cartridge 40 to the holder 130 in the form of an elastic restoring force.

Thereby, the holder 130 is moved forwards by the predetermined stroke distance, and the first hinges 113 rotate relative to the end of the coupling part of the spherical door 120. Simultaneously, the second hinges 135 are stretched according to the distance moved.

Further, the spherical door 120 is rotated at a rotating angle which corresponds to the distance that the holder 130 is moved forwards.

Figure 14:
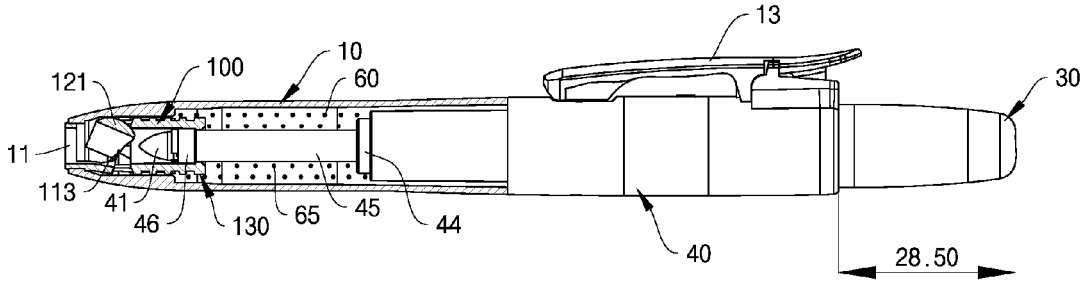

As shown in FIG. 14, when the knock part 30 moves forwards 20 mm more, the second spring 65 continues to push the holder 130 away from the cartridge 40, so that the holder 130 moves forwards. As the holder 130 moves forwards, the spherical door 120 rotates about the first and second hinges 113 and 135.

Figure 15:
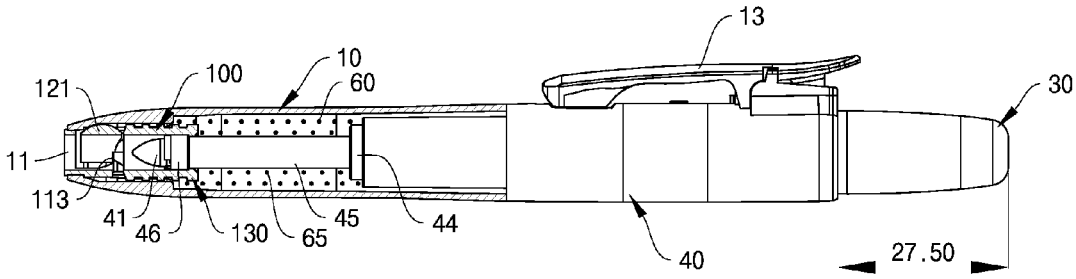

As such, when the forward movement of the holder 130 and the rotation of the spherical door 120 continue, as shown in FIG. 15, a path is defined so that the nib 41 passes through the nib hole 11 and projects out.

At this time, the spherical door 120 rotates 90°, so that the hemispherical surface 121 faces the inner wall of the shaft 10, and each bent second hinge 135 returns to its original state, and is thus flat.

Therefore, the passage of the spherical door 120 is axially aligned with the cartridge 40, so that the passage is opened. Further, the advanced holder 130, the nib 41, and the O-ring 111 are located in the passage.

At this time, a tip of the nib 41 of the cartridge 40 or a surface surrounding the nib is not in contact with the passage of the spherical door 120, so that ink of the nib 41 does not cover the interior of the spherical door 120, and the tip of the nib 41 located in the nib hole 11 can be seen with the naked eyes.

Figure 16:
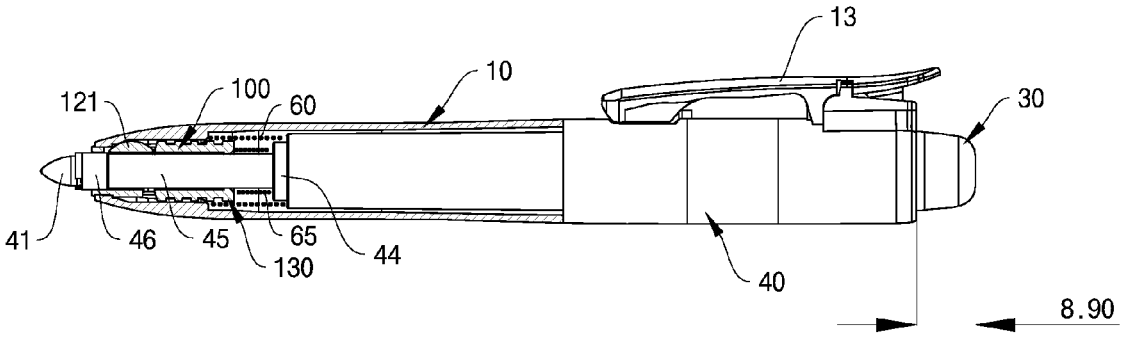

In such a state, as shown in FIG. 16, when the knock part 30 is further pushed by external force, the knock part is moved forwards the entire stroke distance, and the first and second springs 60 and 65 are compressed to the range in which no elastic deformation occurs, so that the maximum elastic restoring force can be generated.

In such a state, a user can use the writing tool of the invention.

Meanwhile, the user performs a switch releasing operation, thus causing the projected nib 41 to be retracted into the shaft 10.

In this case, the writing tool is operated in the sequence from FIG. 16 to FIG. 12, so that the spherical door 120 closes the nib hole 11, and the nib 41 can be safely and air-tightly received in the shaft 10.

That is, the first and second springs 60 and 65 are axially extended by the elastic restoring force. Simultaneously, the holder 130, the knock part 30, and the cartridge 40 of the control module 100 are moved backwards.

Subsequently, as the cartridge 40 continues moving backwards, the step of the connection part 46 of the cartridge contacts the lower opening 131 of the holder 130, and then pulls the holder backwards.

At this time, the spherical door 120 rotates about the first and second hinges at the rotating angle of 90°. The rotated spherical door 120 closes the nib hole 11 airtight.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description, but rather is indicated by the appended claims. All changes that come within the meaning and range of equivalents within the claims are intended to be considered as being embraced within the spirit and scope of the claims.

I claim:

1. A slide type writing tool having a dryness prevention unit, comprising:

a hollow shaft having at a first end thereof a nib hole;

a knock part inserted into an insert hole formed in a second end of the shaft;

a cartridge inserted into the shaft to be concentric with the nib hole, and integrated with the knock part;

a control module made of an elastic material and comprising:

an O-ring part coming into close contact with the nib hole;

a spherical door having a spherical surface to isolate a nib from an exterior;

a tubular holder secured to the cartridge;

a first hinge coupling the O-ring part with the spherical door; and a second hinge integrally coupling the spherical door with the holder; and a spring provided in the shaft, and located between the control module and the cartridge to provide elastic restoring force, whereby, when the knock part is pressed, the spherical door, operated in conjunction with the knock part and the cartridge, is rotated at a rotating angle, thus opening the nib hole of the shaft, therefore causing the nib to be projected outside the nib hole through a passage of the spherical door;

wherein the spherical surface of the spherical door has a hemispherical shape, and the open passage is formed opposite the spherical surface, so that the retraction and projection of the cartridge are carried out through the passage when the writing tool is operated; and wherein the spherical door comprises on opposite sides thereof spire-shaped coupling parts which protrude integrally from the spherical surface, the holder comprises spire-shaped coupling parts which extend vertically from opposite sides of an upper opening of the holder, each of the coupling parts being coupled to the corresponding coupling part via the second hinge to rotate the spherical door.

2. A slide type writing tool having a dryness prevention unit, comprising:

a hollow shaft having at a first end thereof a nib hole;

a knock part inserted into an insert hole formed in a second end of the shaft;

a cartridge inserted into the shaft to be concentric with the nib hole, and integrated with the knock part;

a control module made of an elastic material and comprising:

an O-ring part coming into close contact with the nib hole;

a spherical door having a spherical surface to isolate a nib from an exterior;

a tubular holder secured to the cartridge;

a first hinge coupling the O-ring part with the spherical door; and a second hinge integrally coupling the spherical door with the holder; and a spring provided in the shaft, and located between the control module and the cartridge to provide elastic restoring force, wherein the spring comprises:

a first spring interposed between the shaft and the cartridge, thus biasing the shaft and the cartridge; and a second spring interposed between the cartridge and the control module, thus biasing the cartridge and the control module when the cartridge is moved forwards by pushing the knock part;

whereby, when the knock part is pressed, the spherical door, operated in conjunction with the knock part and the cartridge, is rotated at a rotating angle, thus opening the nib hole of the shaft, therefore causing the nib to be projected outside the nib hole through a passage of the spherical door.

3. A slide type writing tool having a dryness prevention unit, comprising:

a hollow shaft having at a first end thereof a nib hole;

a knock part inserted into an insert hole formed in a second end of the shaft;

a cartridge inserted into the shaft to be concentric with the nib hole, and integrated with the knock part;

a control module made of an elastic material and comprising:

an O-ring part coming into close contact with the nib hole;

a spherical door having a spherical surface to isolate a nib from an exterior;

a tubular holder secured to the cartridge;

a first hinge coupling the O-ring part with the spherical door; and a second hinge integrally coupling the spherical door with the holder; and a spring provided in the shaft, and located between the control module and the cartridge to provide elastic restoring force;

a plurality of ribs provided on a circumference of the holder at regular intervals to maintain a shape of the holder against axially applied force, each of the ribs having a shape of a circular band;

whereby, when the knock part is pressed, the spherical door, operated in conjunction with the knock part and the cartridge, is rotated at a rotating angle, thus opening the nib hole of the shaft, therefore causing the nib to be projected outside the nib hole through a passage of the spherical door.

4. A slide type writing tool having a dryness prevention unit, comprising:

a hollow shaft having at a first end thereof a nib hole;

a knock part inserted into an insert hole formed in a second end of the shaft;

a cartridge inserted into the shaft to be concentric with the nib hole, and integrated with the knock part;

a control module made of an elastic material such as rubber, and comprising:

an O-ring part coming into close contact with the nib hole;

a spherical door having a spherical surface to isolate a nib from an exterior;

a tubular holder secured to the cartridge;

a first hinge coupling the O-ring part with the spherical door; and a second hinge integrally coupling the spherical door with the holder; and a spring provided in the shaft, and located between the control module and the cartridge to provide elastic restoring force;

whereby, when the knock part is pressed, the spherical door, operated in conjunction with the knock part and the cartridge, is rotated at a rotating angle, thus opening the nib hole of the shaft, therefore causing the nib to be projected outside the nib hole through a passage of the spherical door;

wherein the O-ring part comprises an O-ring coming into close contact with an interior of the nib hole, and a vertical bar extending vertically from a predetermined portion of the O-ring, the vertical bar and the spherical door being coupled to each other via the first hinge so that the spherical door rotates relative to the O-ring part.

5. The writing tool according to claim 4, wherein the second hinge deviates slightly from a central point of the spherical surface of the spherical door, thus eliminating friction between the spherical door and the upper opening of the holder when the spherical door rotates.

* * * * *